US006485897B1

(12) United States Patent
Lockhart et al.

(10) Patent No.: US 6,485,897 B1
(45) Date of Patent: Nov. 26, 2002

(54) SPECTRAL SENSITIZED SILVER HALIDE ELEMENT FOR ELECTRONIC FILMWRITER DEVICE

(75) Inventors: Kristen D. Lockhart, Rochester, NY (US); Cheryl S. Johnston, Fairport, NY (US); Mark E. Johnson, Bellevue, WA (US); David L. Fridd, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/862,923

(22) Filed: May 22, 2001

(51) Int. Cl.[7] ..... G03C 7/00

(52) U.S. Cl. ..... 430/363; 430/503; 430/570; 430/572; 430/576; 430/581; 430/585

(58) Field of Search ..... 430/502, 503, 430/570, 576, 572, 581, 585, 363

(56) References Cited

U.S. PATENT DOCUMENTS

| | | | | |
|---|---|---|---|---|
| 4,954,429 A | | 9/1990 | Urata | |
| 5,053,324 A | | 10/1991 | Sasaki | |
| 5,079,132 A | | 1/1992 | Mitsui et al. | |
| 5,154,995 A | | 10/1992 | Kawai | |
| 5,180,657 A | | 1/1993 | Fukazawa et al. | |
| 5,200,308 A | | 4/1993 | Ohtani et al. | |
| 5,206,126 A | | 4/1993 | Shimazaki et al. | |
| 5,210,014 A | | 5/1993 | Anderson et al. | |
| 5,258,273 A | | 11/1993 | Ezaki et al. | |
| 5,286,617 A | | 2/1994 | Otani et al. | |
| 5,350,665 A | | 9/1994 | Hasebe et al. | |
| 5,415,978 A | | 5/1995 | Asami et al. | |
| 5,541,040 A | | 7/1996 | Okawauchi et al. | |
| 5,582,961 A | | 12/1996 | Giorgianni et al. | |
| 5,609,978 A | | 3/1997 | Giorgianni et al. | |
| 6,143,482 A | * | 11/2000 | Buitano et al. | 430/506 |
| 6,251,578 B1 | * | 6/2001 | Buitano et al. | 430/572 |

FOREIGN PATENT DOCUMENTS

| | | |
|---|---|---|
| EP | 0 294 193 A2 | 7/1988 |
| EP | 0 409 019 B1 | 7/1990 |
| JP | 7013288 | 1/1995 |

OTHER PUBLICATIONS

JP Abstract 7013288, 1995, WPI Acc. No. 95–086271.
Derwent Abstract J6–1267–756–A, Nov. 27, 1986.
Derwent Abstract J6 3030–844–A, Feb. 9, 1988.

* cited by examiner

*Primary Examiner*—Geraldine Letscher
(74) *Attorney, Agent, or Firm*—Sarah Meeks Roberts

(57) ABSTRACT

This invention relates to a photographic element comprising a support having thereon light sensitive silver halide layers comprising at least one red light sensitive silver halide layer, at least one green light sensitive silver halide layer, and at least one blue sensitive silver halide layer, wherein the green light sensitive silver halide layer has an absorption spectra having a maximum absorption at a wavelength λmax from 530 to 560 nm and a half bandwidth less than 50 nm; and the red light sensitive silver halide layer has an adsorption spectra having a maximum absorption at a wavelength λmax from 610 to 640 nm, and exhibiting from 30 nm hypsochromic of the wavelength of maximum absorption and below an area less than 40% based on the total area of the red light sensitive silver halide layer adsorption spectra. It further relates to a method of processing said element using an electronic filmwriter device.

21 Claims, 1 Drawing Sheet

SPECTRAL SENSITIZED SILVER HALIDE ELEMENT FOR ELECTRONIC FILMWRITER DEVICE

FIELD OF THE INVENTION

This invention relates to a new spectral sensitized silver halide film. Specifically, the invention relates to a new sensitized silver halide film used to form images by exposure to electronic filmwriter devices and a method for forming the image.

BACKGROUND OF THE INVENTION

It is well known to expose silver halide photographic elements using light radiation, the silver halide element being usually placed in a camera. Electronic filmwriter devices represent a different means of exposing a photographic film other than a camera. These devices usually contain three different light sources, one that exposes the red portion of an image, one that exposes the green portion, and one that exposes the blue portion. Examples of electronic filmwriter devices are the Saphire and Solitaire by MGI, Lightjet by CSI, Miruswriter Turbopro II by Mirus Industries, and LVT by Dice. These devices have different types of light sources having different spectral power distributions. The Saphire, Solitaire, and Miruswriter all have CRT light sources, Lightjet contains laser sources, and the LVT contains LED sources.

Information is supplied to the device that digitally describes the original scene's content. This information originates from either a camera image or a computer. In the case where the camera image is the source of the information to the device, the image is scanned so that digital values can be supplied to the device. The supplied information is then used to expose an output film. In the case where the original image is generated by a computer, the information is already in digital form.

Signal processing of the supplied information is performed within the device to determine the intensity and time of exposures that the three light sources are to give the output film. Typically, when the film is exposed, the filmwriter device must scan over the entire area of the film to expose each color record of the output film. The extent of exposure of the output film, and hence, the amount of dye formation, depends in part on the spectral sensitivity distributions of the film and the spectral power distributions of the light sources of the electronic filmwriter device.

U.S. Pat. No. 4,954,429 discloses a film for laser recording. The disclosed film is spectral sensitized to minimize unwanted dye formation to prevent 'color mixing.' The result is obtained from the specific ratio of the sensitivity of the light sensitive emulsion layers constituting the film.

Often films which are exposed by electronic filmwriter devices are films which are spectrally optimized to be exposed by natural light radiation, not the light source of an electronic filmwriter device. As a result, when these films are used as the imaging media from an electronic filmwriter device, extra 'scans' by the light sources are often needed. It is know that extra scans are often required for proper exposure by the green light source of the filmwriter device. When conventional reversal films are exposed by an electronic filmwriter device, extra scans by the red light source are also often required to decrease the amount of cyan density that forms in the low density region of images. These extra scans undesirably increase the completion time of the image. This affects the throughput of the machine.

SUMMARY OF THE INVENTION

This invention provides a photographic element comprising a support having thereon light sensitive silver halide layers comprising at least one red light sensitive silver halide layer, at least one green light sensitive silver halide layer, and at least one blue sensitive silver halide layer, wherein the green light sensitive silver halide layer has an absorption spectra having a maximum absorption at a wavelength λmax from 530 to 560 nm and a half bandwidth less than 50 nm; and the red light sensitive silver halide layer has an adsorption spectra having a maximum absorption at a wavelength λmax from 610 to 640 nm, and exhibiting from 30 nm hypsochromic of the wavelength of maximum absorption and below an area less than 30% based on the total area of the red light sensitive silver halide layer adsorption spectra. This invention also provides a process for forming a photographic image which comprises exposing the above photographic element with light sources from an electronic filmwriter device.

The present invention provides a silver halide element that shows sensitometric advantages when exposed by an electronic filmwriter device. The film of the present invention exhibits increased green and red spectral sensitivities. The increased red and green sensitivities decrease the time the element needs to be exposed by the red and green light sources of the electronic film writer. This provides an advantageous time saving for the completion of the image. Other and further advantages of the invention will appear from the description of the present invention

DETAILED DESCRIPTION OF THE INVENTION

Figure 1:
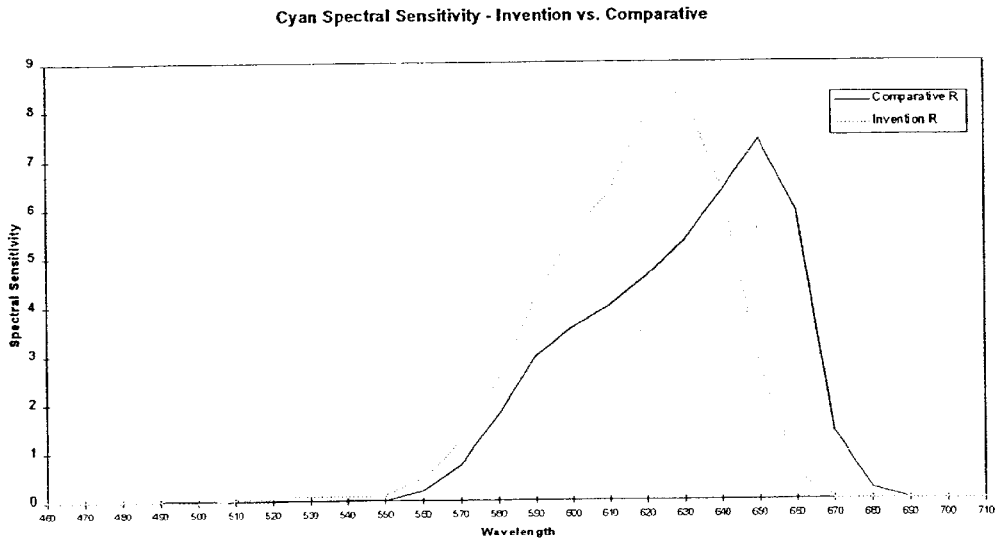
FIG. 1 shows the cyan spectral sensitivity of sample 102 illustrating the present invention versus the cyan spectral sensitivity of comparative sample 103, discussed more fully below.

The photographic elements of this invention comprise a support having thereon light sensitive silver halide layers comprising at least one red light sensitive silver halide layer, at least one green light sensitive silver halide layer, and at least one blue sensitive silver halide layer. The green light sensitive silver halide layer has an absorption spectra having a maximum absorption at a wavelength λmax from about 530 to about 560 nm and a half bandwidth less than 50 nm, and more preferably between 35 to 50 nm. The red light sensitive silver halide layer has an adsorption spectra having a maximum absorption at a wavelength λmax from about 610 to about 640 nm and more preferably a maximum absorption at a wavelength λmax from 620 to 640 nm. The red layer further exhibits from 30 nm hypsochromic of the wavelength of maximum absorption and below (meaning further to the left) an area less than 40% based on the total area of the red light sensitive silver halide layer adsorption spectra. More preferably, the area of the absorption spectra from 30 nm hypsochromic of the wavelength of maximum absorption and below is less than 35% based on the total area of the red light sensitive silver halide layer adsorption spectra.

In the present invention, the green sensitive layer can contain any of known sensitizing dyes that exhibits an absorption spectra as previously defined. In one suitable embodiment of the invention, the green sensitive layer contains a sensitizing dye having the following Formula (I):

(I)

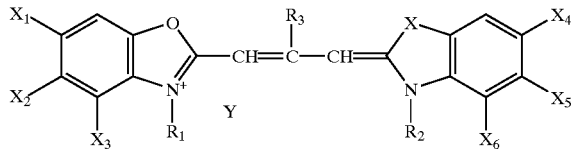

wherein $R_1$ and $R_2$ independently are an alkyl group having 1 to 6 carbon atoms and $R_3$ is an aryl or an alkyl group having 1 to 4 carbon atoms. $X_1$, $X_2$, $X_3$, $X_4$, $X_5$, and $X_6$ independently are hydrogen, halogen or alkyl alkoxy, aryl, heteroaryl or acetamido groups, or $X_1$ and $X_2$, $X_2$ and $X_3$, $X_4$ and $X_5$, $X_5$ and $X_6$ can each independently be combined to form a saturated or unsaturated cyclic group, preferably a fused benzene group. Preferably $X_2$ and $X_2$ are not phenyl or or other aryl groups. X is O or N—$R_4$ wherein $R_4$ is an alkyl group having 1 to 6 carbon atoms. Y represents an ion as needed to balance the charge of the sensitizing dye.

In another suitable embodiment of the invention, the green sensitive layer alternatively contains a sensitizing dye having the following Formula (II):

(II)

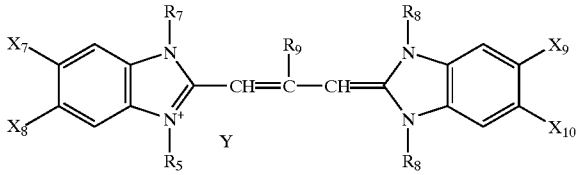

wherein $R_7$ and $R_8$ are methyl or ethyl groups provided that at least one of $R_7$ and $R_8$ is a methyl group. $R_5$ and $R_6$ are alkyl groups having from 1 to 6 carbon atoms, provided that $R_5$ and $R_6$ are not both methyl groups. $R_9$ is hydrogen. $X_7$, $X_8$, $X_9$, and $X_{10}$ are each independently methyl, fluoro-substituted methyl or methylthio groups, or hydrogen, provided that at least one of $X_7$ and $X_8$ and at least one of $X_9$ and $X_{10}$ are not hydrogen. Y represents an ion as needed to balance the charge of the sensitizing dye. The sensitizing dye of formula (II) is disclosed in detail in U.S. Pat. No. 5,210,014 of Anderson et al incorporated herein by reference.

Examples of $R_1$ and $R_2$ or $R_5$ and $R_6$ include lower alkyls such as methyl, ethyl, propyl, butyl, pentyl, and hexyl. According to one embodiment, one or both $R_1$ and $R_2$ or $R_5$ and $R_6$ contains an acid solubilizing group and the term alkyl group when referring to $R_1$, $R_2$, $R_5$ or $R_6$ includes alkyl groups containing such acid solublizing groups. Preferably $R_1$ and $R_2$ or $R_5$ and $R_6$ are both sulfoalkyl groups.

Depending upon the $R_1$, $R_2$, $R_5$ or $R_6$ groups, a counterion Y may be necessary to balance the charge of the sensitizing dye. For example, if the sensitizing dye is substituted with two anionic groups (e.g., sulfo), then Y will be a cation. If the dye molecule is substituted with only one anionic group, the counterion Y is not present. If the sensitizing dye is substituted with no anionic group, Y will be an anion. Such counter ions are well known in the art, and examples thereof include cations such as sodium, potassium, triethylammonium, and the like, and anions such as chloride, bromide, iodide, p-toluene sulfonate, methane sulfonate, methyl sulfate, ethyl, sulfate, perchlorate, fluoroborate, and the like.

Illustrative examples of sensitizing dyes of Formula (I) include the following:

I-1

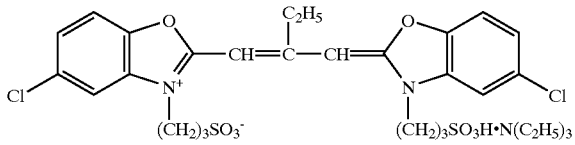

I-2

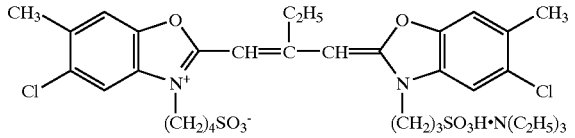

I-3

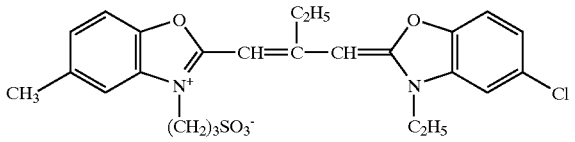

I-4

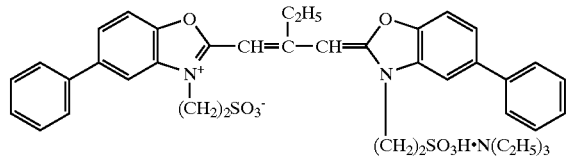

I-5

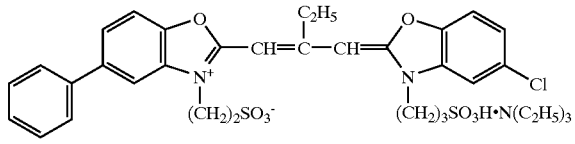

I-6

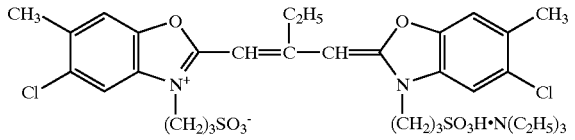

I-7

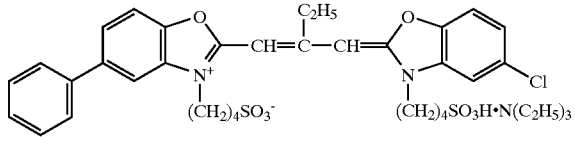

I-8

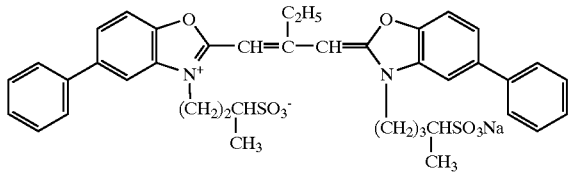

-continued
I-9
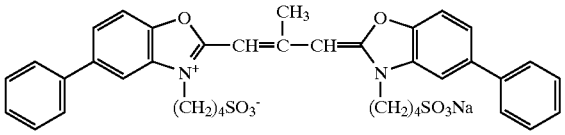
I-10
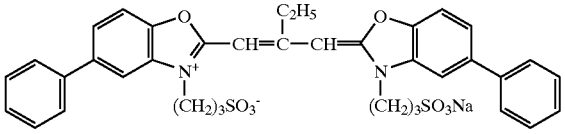
I-11
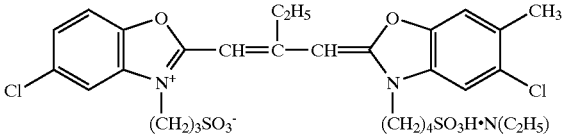
I-12
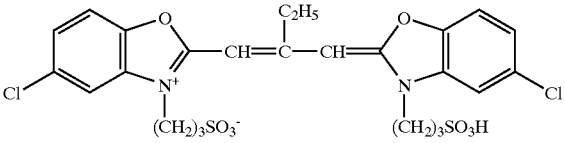
I-13
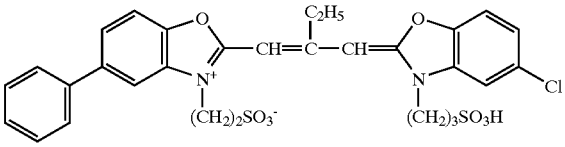
I-14
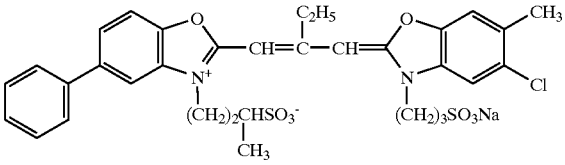
I-15
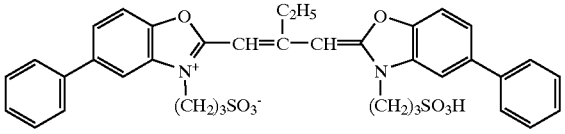
I-16
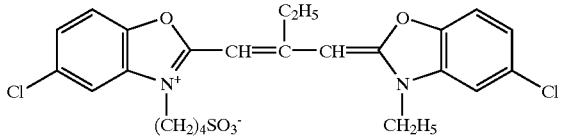
I-17
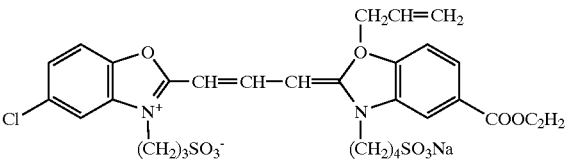
-continued
I-18
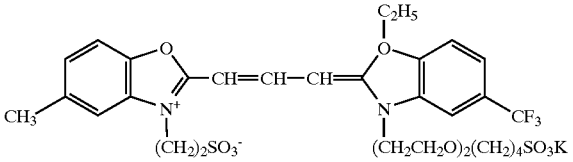
I-19
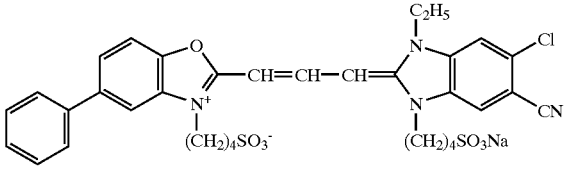
I-20
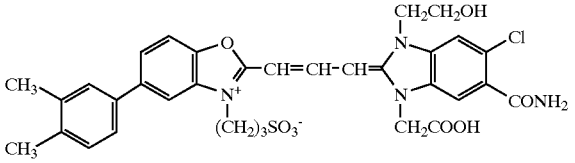
I-21
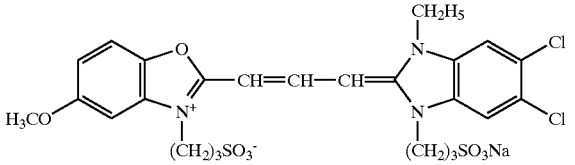
I-22
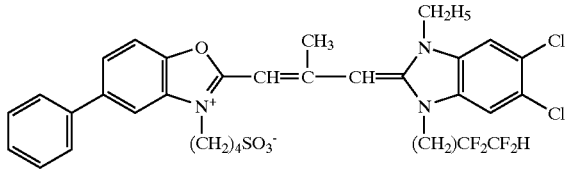
I-23
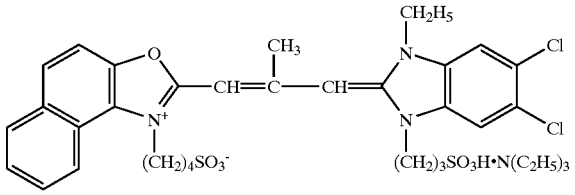
I-24
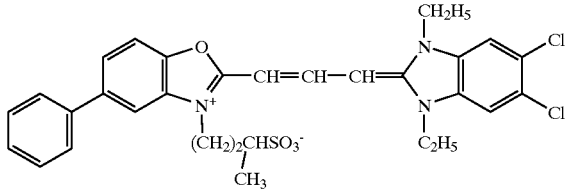
I-25
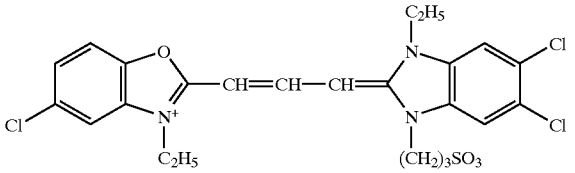

-continued

I-26

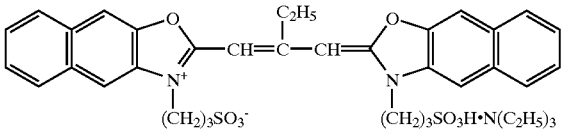

I-27

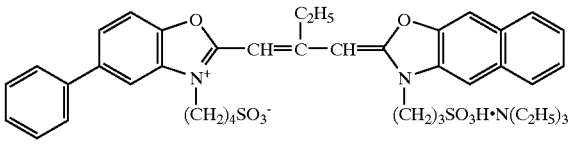

I-28

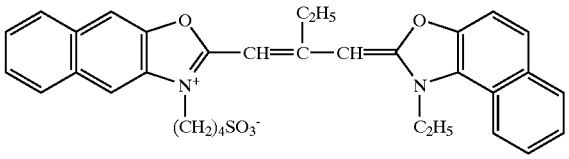

I-29

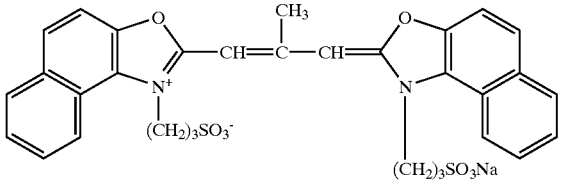

-continued

I-30

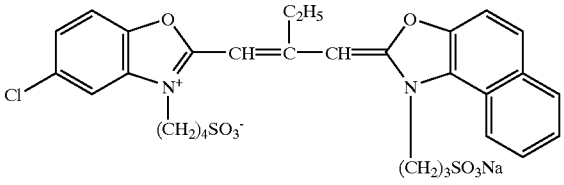

I-31

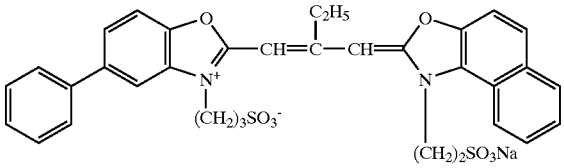

Illustrative examples of sensitizing dyes of Formula II are listed in Table I:

(II)

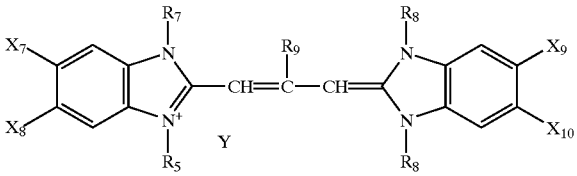

TABLE I

| Dye | $R_5$ | $R_6$ | $R_7$ | $R_8$ | $X_7$ | $X_8$ | $X_9$ | $X_{10}$ |
|---|---|---|---|---|---|---|---|---|
| II-1 | SP⁻ | SP⁻ | Me | Me | H | SMe | H | SMe |
| II-2 | Et | Et | Me | Me | H | SMe | H | SMe |
| II-3 | Me | SP⁻ | Me | Me | Me | Me | H | $CF_3$ |
| II-4 | SP⁻ | Et | Et | Me | H | $CF_3$ | Me | Me |
| II-5 | SP⁻ | Me | Et | Me | H | $CF_3$ | H | Me |
| II-6 | Et | SP⁻ | Me | Me | H | SMe | H | $CF_3$ |
| II-7 | SP⁻ | Et | Me | Me | H | $CF_3$ | H | $CF_3$ |
| II-8 | Et | SP⁻ | Et | Me | H | $CF_3$ | H | $CF_3$ |
| II-9 | TFE | SP⁻ | Me | Me | H | $CF_3$ | H | $CF_3$ |
| II-10 | SP⁻ | SP⁻ | Me | Me | H | $CF_3$ | H | $CF_3$ |
| II-11 | TFE | SP⁻ | Et | Me | H | $CF_3$ | H | $CF_3$ |
| II-12 | TFE | TFE | Me | Me | H | $CF_3$ | H | $CF_3$ |
| II-13 | Et | Et | Me | Me | SMe | $CF_3$ | SMe | $CF_3$ |
| II-14 | $CH_2COOMe$ | SP⁻ | Me | Me | H | $CF_3$ | H | $CF_3$ |
| II-15 | $CH_2COOMe$ | SP⁻ | Et | Me | H | $CF_3$ | H | $CF_3$ |
| II-16 | $CH_2COOMe$ | SP⁻ | Me | Et | H | $CF_3$ | H | $CF_3$ |
| II-17 | $CH_2CONH_2$ | SP⁻ | Et | Me | H | $CF_3$ | H | $CF_3$ |
| II-18 | $CH_2COOEt$ | SP⁻ | Et | Me | H | $CF_3$ | H | $CF_3$ |
| II-19 | $CH_2COOPr$ | SP⁻ | Et | Me | H | $CF_3$ | H | $CF_3$ |
| II-20 | $CH_2CONMe_2$ | SP⁻ | Et | Me | H | $CF_3$ | H | $CF_3$ |
| II-21 | SECM⁻ | TFE | Me | Me | SMe | $CF_3$ | SMe | $CF_3$ |
| II-22 | TFE | TFE | Me | Et | Me | $CF_3$ | Me | $CF_3$ |
| II-23 | $CH_2CN$ | SP⁻ | Me | Et | H | $CF_3$ | H | $CF_3$ |

TABLE I-continued

| Dye | $R_5$ | $R_6$ | $R_7$ | $R_8$ | $X_7$ | $X_8$ | $X_9$ | $X_{10}$ |
|---|---|---|---|---|---|---|---|---|
| II-24 | Et | Et | Me | Me | $CF_3$ | $CF_3$ | $CF_3$ | $CF_3$ |
| II-25 | TFE | $CH_2COOMe$ | Me | Me | Me | $CF_3$ | Me | $CF_3$ |
| II-26 | $SECM^-$ | Et | Me | Me | H | $CF_3$ | H | $CF_3$ |
| II-27 | TFE | $4SB^-$ | Me | Me | H | $CF_3$ | H | $CF_3$ |
| II-28 | TFE | $3SB^-$ | Me | Me | H | $CF_3$ | H | $CF_3$ |
| II-29 | TFE | $SE^-$ | Me | Me | H | $CF_3$ | H | $CF_3$ |
| II-30 | TFE | $MSCM^-$ | Me | Me | H | $CF_3$ | H | $CF_3$ |

Me = Methyl
Et = Ethy
TFE = Trifluoroethyl
$SE^-$ = Sulfoethy
$SP^-$ = Sulfopropyl
$MSCM^-$ = Methylsulfonylcarbamoylmethyl
$SECM^-$ = Sulfoethylcarbamoylmethy
SMe = Methylthio
$3SB^-$ = 3-sulfobutyl
$4SB^-$ = 4-sulfobutyl Dye II-1 has a potassium counterion Y, dyes II-2, II-13, II-22 and II-24 have p-toluene sulfonate counterions Y, dye II-10 has a sodium counterion Y, dye II-12 has a fluoroborate counterion Y, and dye II-25 has a bromide counterion Y associated therewith. The particular counterion is not critical, however, and others may be selected, for example, from those listed above.

When the above green sensitizing dyes are used, the amount of green sensitizing dye that is useful in the invention is generally in the range of 0.1 to 4 millimoles per mole of silver halide and preferably from 0.5 to 3.0 millimoles per mole of silver halide.

In the present invention, the red sensitive layer can contain any known red sensitizing dyes exhibiting an adsorption spectrum having the features required by the present invention. In one suitable embodiment, the red sensitive layer contain a sensitizing dye combination containing a sensitizing dye having the Formula (III) and a sensitizing dye having the following Formula (IV):

(III)

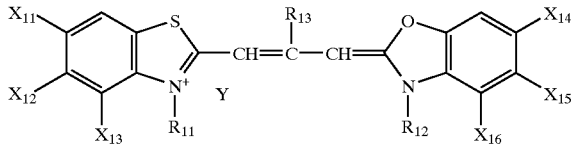

(IV)

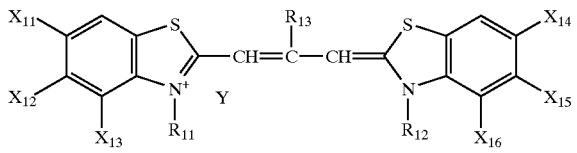

In the above forumlas $R_{11}$ and $R_{12}$ independently are an alkyl group having from 1 to 6 carbon atoms and $R_{13}$ is an aryl group or an alkyl group having from 1 to 4 carbon atoms. $X_{11}$, $X_{12}$, $X_{13}$, $X_{14}$, $X_{15}$ and $X_{16}$ are independently hydrogen, halogen or alkyl, alkoxy, aryl, heteroaryl, or acetamido groups, or $X_{11}$ and $X_{12}$, $X_{12}$ and $X_{13}$, $X_{14}$ and $X_{15}$, or $X_{15}$ and $X_{16}$ can each independently be combined to form a saturated or unsaturated cyclic group, preferably a fused benzene group. It is preferred, however, that there are no fused ring or aryl substituents. Y represents an ion as needed to balance the charge of the sensitizing dye.

Examples of $R_{11}$ and $R_{12}$ include lower alkyls such as methyl, ethyl, propyl, butyl, pentyl, and hexyl. According to one embodiment, one or both of $R_{11}$ and $R_{12}$ contains an acid solubilizing group, and the term "alkyl" group when referring to $R_{11}$ and $R_{12}$ includes alkyl groups containing such acid solublizing groups. Preferably $R_{11}$ and $R_{12}$ are both sulfoalkyl groups As described for the dyes contained in the green sensitive layer, depending upon the $R_{11}$ and $R_{12}$ groups, a counterion Y may be necessary to balance the charge of the sensitizing dye. Such counterions are well known in the art, and examples thereof include cations such as sodium, potassium, triethylammonium, and the like, and anions such as chloride, bromide, iodide, p-toluene sulfonate, methane sulfonate, methyl sulfate, ethyl, sulfate, perchlorate, fluoroborate, and the like.

Illustrative xamples of compounds having Formula III include:

III-1

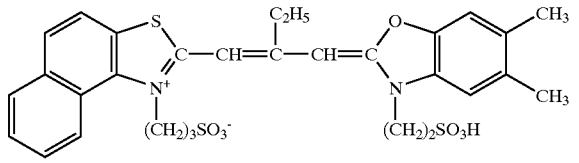

III-2

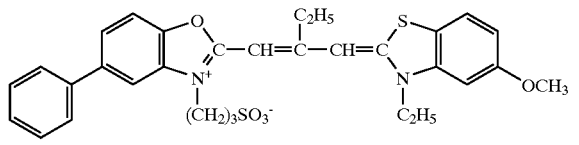

III-3

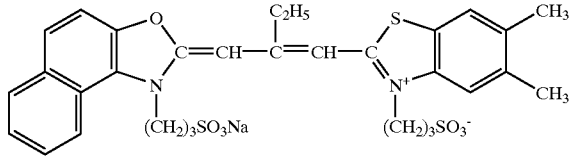

-continued
III-4
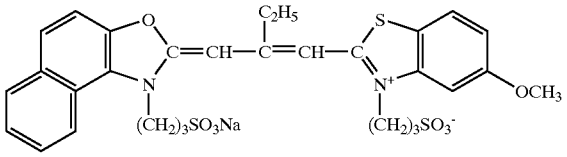
III-5
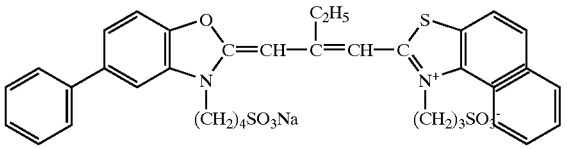
III-6
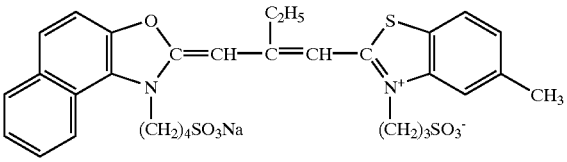
III-7
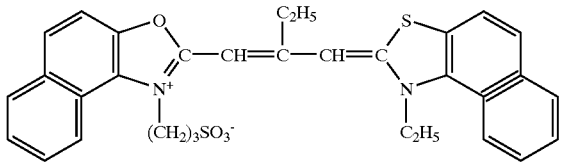
III-8
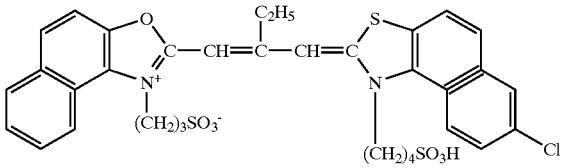
III-9
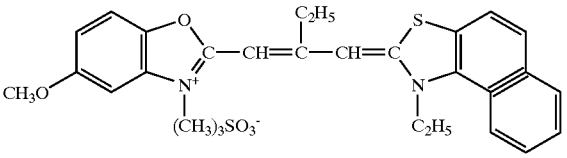
III-10
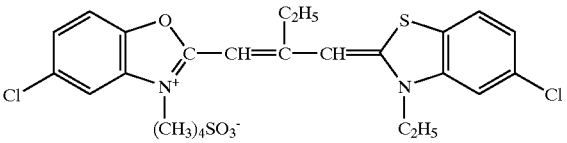
III-11
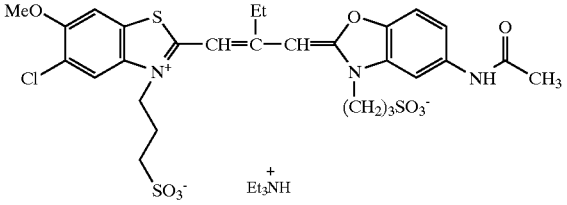
Illustrative examples of compounds having Formula IV include the following:
IV-1
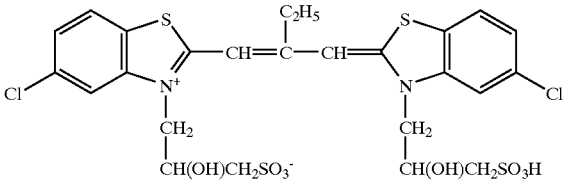
IV-2
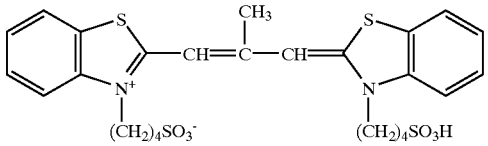
IV-3
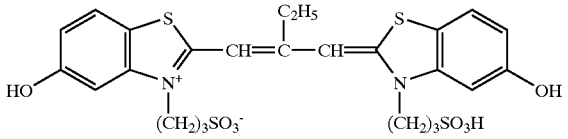
IV-4
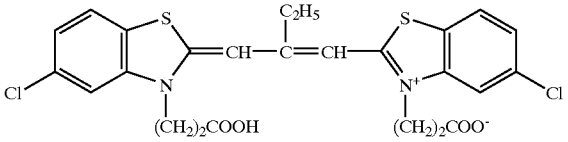
IV-5
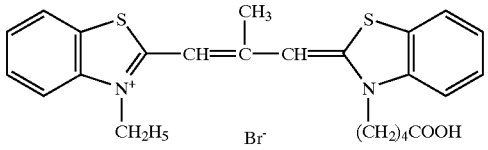
IV-6
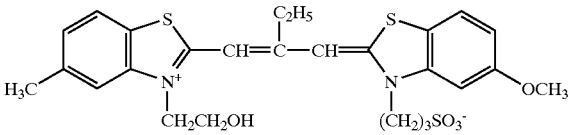
IV-7
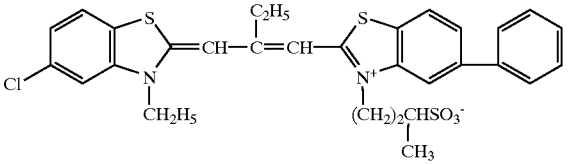
IV-8
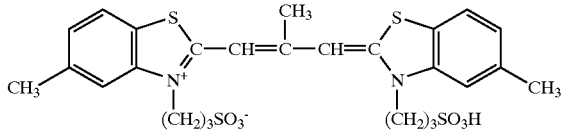

-continued

IV-9

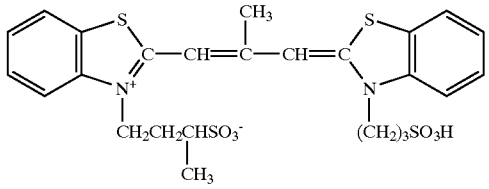

IV-10

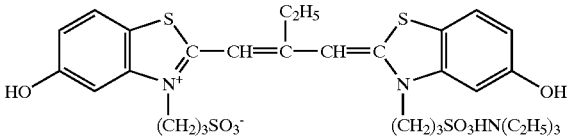

IV-11

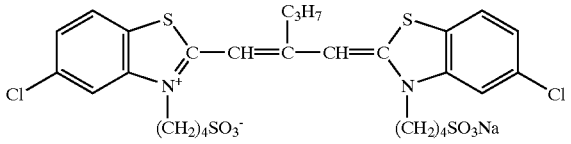

IV-12

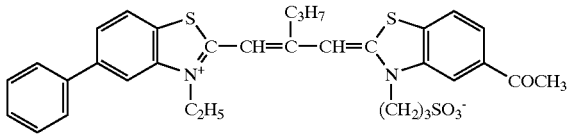

IV-13

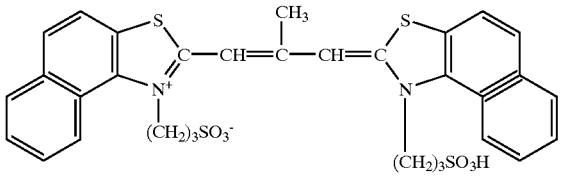

IV-14

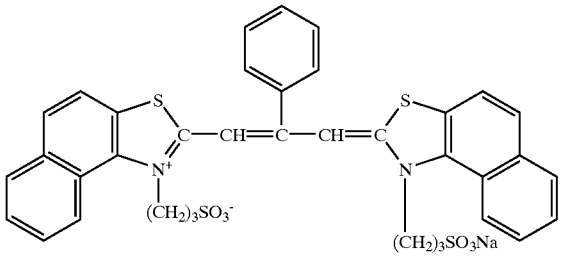

IV-15

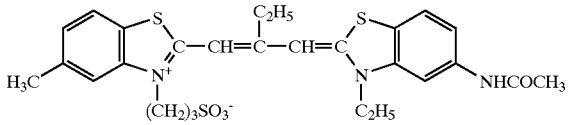

When the above red sensitizing dye combination is used, the amount of red sensitizing dye that is useful in the invention is preferably in the range of 0.1 to 4 millimoles per mole of silver halide and more preferably from 0.5 to 3.0 millimoles per mole of silver halide.

When reference in this application is made to a particular group, unless otherwise specifically stated, the group may itself be unsubstituted or substituted with one or more substituents (up to the maximum possible number). For example, "alkyl" group refers to a substituted or unsubstituted alkyl group, while "benzene " refers to a substituted or unsubstituted benzene (with up to six substituents). The substituent may be itself substituted or unsubstituted.

Generally, unless otherwise specifically stated, substituents include any substituents, whether substituted or unsubstituted, which do not destroy properties necessary for the photographic utility. Examples of substituents include known substituents such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5- or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

The element of the invention further comprises a blue sensitive layer containing any known blue spectral sensitizing dye. In the element of the present invention, the blue sensitive layer usually shows an adsorption spectra having a maximum adsorption at a wavelength between 400 and 500 nm.

Spectral sensitizing dyes are well known in the art and are disclosed, for example, in *Research Disclosure,* September 1996, 38957, Section V. The dyes useful in the element of the invention can be prepared by synthetic techniques well known in the art. Such techniques are further illustrated, for example, in "The Cyanine Dyes and Related Compounds", Frances Hamer, Interscience Publishers, 1964 and James, The Theory of the Photographic Process 4th, 1977. Optimum spectral sensitizing dye concentrations will depend on the nature of the spectral sensitizing used and on the intended end use of the photographic material and can be determined by methods well known in the art.

The element of the invention can be any known silver halide photographic element. These elements include silver halide photographic films, silver halide photographic papers, negative working elements, positive working elements, reversal photographic elements, and the like.

The photographic elements made in accordance with the present are generally multicolor elements containing dye image-forming units sensitive to each of the three primary regions of the spectrum. Each unit can be comprised of a single emulsion layer or of multiple emulsion layers sensitive to a given region of the light spectrum. The photographic emulsions conventionally contain silver halide grains. Grains containing combinations of halides most frequently employed for latent image formation include silver iodochloride, silver iodobromide, silver chlorobromide, silver iodochlorobromide, silver chloroiodobromide, silver bromochloride, silver iodobromochloride and silver bromoiodochloride grains, where the halides are named in order of ascending concentrations. The silver halide emulsions can be chemically sensitized with active gelatin as illustrated by T. H. James, *The Theory of the Photographic Process,* 4th Ed., Macmillan, 1977, pp. 67–76, or with middle chalcogen (sulfur, selenium or tellurium), gold, a platinum metal (platinum, palladium, rhodium, ruthenium, iridium and osmium), rhenium or phosphorus sensitizers or combinations of these sensitizers.

The element can contain further to the layers already disclosed additional layers, such as interlayers, filter layers, overcoat layers, subbing layers, and the like. All of these can be coated on a support that can be transparent or reflective (for example, a paper support). Typical photographic supports include polymeric film, wood fiber—e.g., paper, metallic sheet and foil, glass and ceramic supporting elements provided with one or more subbing layers.

According to one embodiment, the element of the invention is a reversal element and comprises a support having thereon in the following order, a red-light sensitive layer having a cyan dye-forming color coupler associated therewith; a green-light sensitive layer having a magenta dye-forming color coupler associated therewith and, and a blue-light sensitive layer having a yellow dye-forming color coupler associated therewith. Color reversal elements are those containing negative-working emulsions and intended to be developed using a reversal process.

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film). One well-known reversal process is Kodak Process E-6, Eastman Kodak Company.

In a typical construction, a reversal film does not have any masking couplers. Furthermore, reversal films have a gamma generally between 1.5 and 2.0, and this is much higher than for typical negative materials.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, and in *Research Disclosure,* September 1997, Item 40145 published by Kenneth Mason Publications, Ltd., Dudley Annex, 12a North Street, Emsworth, Hampshire PO10 7DQ, ENGLAND, the disclosures of which are incorporated herein by reference.

| Reference | Section | Subject Matter |
|---|---|---|
| 1 | I, II | Grain composition, |
| 2 | I, II, IX, X, XI, XII XIV, XV | morphology and preparation. Emulsion preparation including hardeners, coating |
| 3 & 4 | I, II, III, IX A & B | aids, addenda, etc. |
| 1 | III, IV | Chemical sensitization and |
| 2 | III, IV | spectral sensitization/ |
| 3 & 4 | IV, V | Desensitization |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be exposed with various forms of energy which encompass the ultraviolet, visible, and infrared regions of the electromagnetic spectrum, as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements. The photographic elements are preferably exposed using the various energy sources utilized by electronic filmwriter devices, such as CRT light sources, laser sources, and LED sources.

Next, a more detailed description of the invention will be made. However, it is to be understood that the present invention is not limited to the following examples.

EXAMPLE 1

Comparative sample 101 was prepared according to the following description. The layers described below were coated on a cellulose triacetate film support to form a multilayer color photographic material. The coating amounts listed below are in the unit of g/m$^2$ except for sensitizing dyes which are listed in terms of molar amount per mole of silver halide present in the same layer. "ECD" refers to equivalent circular diameter. "%I" refers to the mole percent of total iodide content.

| | |
|---|---|
| First Layer: Antihalation Layer | |
| Antihalation Colloidal Silver | 0.25 |
| UV Protection Dye UV-1 | 0.04 |
| Dispersed in Solvent S-1 | 0.04 |
| Gelatin | 2.44 |
| Second Layer: Intermediate Layer | |
| Fine Grain Silver Bromide (0.055 mm ECD) | 0.05 |
| Scavenger SCV-1 | 0.11 |
| Gelatin | 1.22 |
| Third Layer: Slow Red Sensitive Layer | |
| Silver Iodobromide Emulsion (0.44 μm ECD × 0.06 μm - 4% I) | 0.25 |
| Spectrally sensitized with | |
| Red Sensitizing Dye SD-1 | $7.88 \times 10^{-4}$ |
| Red Sensitizing Dye SD-2 | $3.39 \times 10^{-4}$ |
| Fine Grain Silver Bromide (0.055 μm ECD) | 0.04 |
| Coupler C-1 | 0.09 |
| Dispersed in Solvent S-3 | 0.04 |
| Gelatin | 0.08 |
| Fourth Layer: Mid Red Sensitive Layer | |
| Silver Iodobromide Emulsion (0.86 μm ECD ×0.09 μm - 4% I) | 0.32 |
| Spectrally sensitized with | |
| Red Sensitizing Dye SD-1 | $6.13 \times 10^{-4}$ |
| Red Sensitizing Dye SD-2 | $2.64 \times 10^{-4}$ |
| Fine Grain Silver Bromide (0.055 μm ECD) | 0.05 |
| Coupler C-1 | 0.4 |
| Dispersed in Solvent S-3 | 0.2 |
| Gelatin | 0.73 |
| Fifth Layer: Fast Red Sensitive Layer | |
| Silver Iodobromide Emulsion (1.15 μm ECD × 0.10 μm - 3%) | 0.46 |
| Spectrally sensitized with | |
| Red Sensitizing Dye SD-1 | $5.48 \times 10^{-4}$ |
| Red Sensitizing Dye SD-2 | $2.21 \times 10^{-4}$ |
| Fine Grain Silver Iodobromide (0.15 μm ECD - 4.8% I) | 0.05 |
| Fine Grain Silver Bromide (0.055 μm ECD) | 0.03 |
| Coupler C-1 | 0.70 |
| Dispersed in Solvent S-3 | 0.35 |
| Gelatin | 1.18 |
| Sixth Layer: Intermediate Layer | |
| Filter Dye FD-1 | 0.07 |
| Scavenger SCV-01 | 0.16 |
| Gelatin | 0.92 |
| Inhibitor I-1 | 0.001 |
| Seventh Layer: Slow Green Sensitive Layer | |
| Silver Iodobromide Emulsion (0.40 μm ECD × 0.06 μm - 4% I) | 0.31 |
| Spectrally sensitized with | |
| Green Sensitizing Dye SD-5 | $1.26 \times 10^{-3}$ |
| Green Sensitizing Dye SD-6 | $3.74 \times 10^{-4}$ |
| Fine Grain Silver Bromide (0.055 μm ECD) | 0.04 |
| Coupler M-1 | 0.07 |
| Coupler M-2 | 0.03 |
| Co-dispersed in Solvent S-2 | 0.05 |
| Gelatin | 0.47 |
| Eighth Layer: Mid Green Sensitive Layer | |
| Silver Iodobromide Emulsion- (1.27 μm ECD × 0.14 μm - 3% I) | 0.38 |

-continued

| | |
|---|---|
| Spectrally sensitized with | |
| Green Sensitizing Dye SD-5 | $1.10 \times 10^{-3}$ |
| Green Sensitizing Dye SD-6 | $3.49 \times 10^{-4}$ |
| Coupler M-1 | 0.34 |
| Coupler M-2 | 0.15 |
| Co-dispersed in Solvent S-2 | 0.25 |
| Gelatin | 0.91 |
| Ninth Layer: Fast Green Sensitive Layer | |
| Silver Iodobromide Emulsion- (1.27 μm ECD × 0.14 μm - 3% I) | 0.54 |
| Spectrally sensitized with | |
| Green Sensitizing Dye SD-5 | $1.09 \times 10^{-3}$ |
| Green Sensitizing Dye SD-6 | $1.82 \times 10^{-4}$ |
| Fine Grain Silver Iodobromide (0.15 μm ECD - 4.8% I) | 0.04 |
| Coupler M-1 | 0.72 |
| Coupler M-2 | 0.31 |
| Co-dispersed in Solvent S-2 | 0.52 |
| Gelatin | 1.78 |
| Tenth Layer: Intermediate Layer | |
| Gelatin | 0.61 |
| Eleventh Layer: Yellow Filter Layer | |
| Carey Lea Silver | 0.07 |
| Gelatin | 0.61 |
| Twelfth Layer: Intermediate Layer | |
| Scavenger SCV-1 | 0.11 |
| Hardener H-1 | 1.38% total gel |
| Gelatin | 0.75 |
| Thirteenth Layer: Slow Blue Sensitive Layer | |
| Silver Iodobromide Emulsion- (0.49 μm ECD × 0.13 μm - 3% I) | 0.19 |
| Spectrally Sensitized with | |
| Blue Sensitizing Dye SD-7 | $4.71 \times 10^{-4}$ |
| Blue Sensitizing Dye SD-8 | $9.44 \times 10^{-4}$ |
| Silver Iodobromide Emulsion- (1.01 μm ECD × 0.125 μm - 3% I) | 0.22 |
| Spectrally Sensitized with | |
| Blue Sensitizing Dye SD-7 | $3.86 \times 10^{-4}$ |
| Blue Sensitizing Dye SD-8 | $1.16 \times 10^{-3}$ |
| Coupler Y-1 | 0.96 |
| Dispersed in Solvent S-3 | 0.32 |
| Gelatin | 1.32 |
| Fourteenth Layer: Fast Blue Sensitive Layer | |
| Silver Iodobromide Emulsion- (2.67 μm ECD × 0.15 μum) | 0.63 |
| Spectrally Sensitized with | |
| Blue Sensitizing Dye SD-7 | $2.20 \times 10^{-4}$ |
| Blue Sensitizing Dye SD-8 | $6.61 \times 10^{-4}$ |
| Coupler Y-1 | 1.44 |
| Dispersed in Solvent S-3 | 0.48 |
| Gelatin | 1.91 |
| Fifteenth Layer: First Protective Layer | |
| UV Protection Dye UV-1 | 0.09 |
| Dispersed in Latex L-1 | 0.43 |
| UV Protection Dye UV-4 | 0.41 |
| Scavenger SCV-1 | 0.07 |
| Gelatin | 1.40 |
| Filter Dye FD-3 | 0.06 |
| Filter Dye FD-4 | 0.01 |
| Sixteenth Layer: Second Protective Layer | |
| Fine Grain Silver Bromide (0.055 μm ECD) | 0.12 |
| Matte | 0.06 |
| Gelatin | 0.98 |

Sample 102, illustrating an element of the invention, was contructed similarly to sample 101 except for the following changes:

| | |
|---|---|
| Seventh Layer: Slow Green Sensitive Layer | |
| Silver Iodobromide Emulsion- (0.40 μm ECD × 0.06 μm - 4% I) | 0.31 |
| Spectrally sensitized with | |
| Green Sensitizing Dye SD-5 | $1.32 \times 10^{-3}$ |
| Fine Grain Silver Bromide (0.055 μm ECD) | 0.04 |
| Coupler M-1 | 0.07 |
| Coupler M-2 | 0.03 |
| Co-dispersed in Solvent S-2 | 0.10 |
| Gelatin | 0.47 |
| Eighth Layer: Mid Green Sensitive Layer | |
| Silver Iodobromide Emulsion- (0.63 μm ECD × 0.11 μum - 3% I) | 0.380 |
| Spectrally sensitized with | |
| Green Sensitizing Dye SD-5 | $1.28 \times 10^{-3}$ |
| Coupler M-1 | 0.34 |
| Coupler M-2 | 0.15 |
| Co-dispersed in Solvent S-2 | 0.20 |
| Gelatin | 0.91 |
| Ninth Layer: Fast Green Sensitive Layer | |
| Silver Iodobromide Emulsion- (1.27 μm ECD × 0.14 μm - 3% I) | 0.54 |
| Spectrally sensitized with | |
| Green Sensitizing Dye SD-5 | $1.32 \times 10^{-3}$ |
| Fine Grain Silver Iodobromide (0.15 μm ECD - 4.8% I) | 0.04 |
| Coupler M-1 | 0.72 |
| Coupler M-2 | 0.31 |
| Co-dispersed in Solvent S-2 | 0.52 |
| Gelatin | 1.78 |
| Fifteenth Layer: First Protective Layer | |
| UV Protection Dye UV-1 | 0.09 |
| Dispersed in Latex L-1 | 0.43 |
| UV Protection Dye UV-4 | 0.41 |
| Scavenger SCV-1 | 0.07 |
| Gelatin | 1.40 |
| Filter Dye FD-4 | 0.01 |

Figure 2:
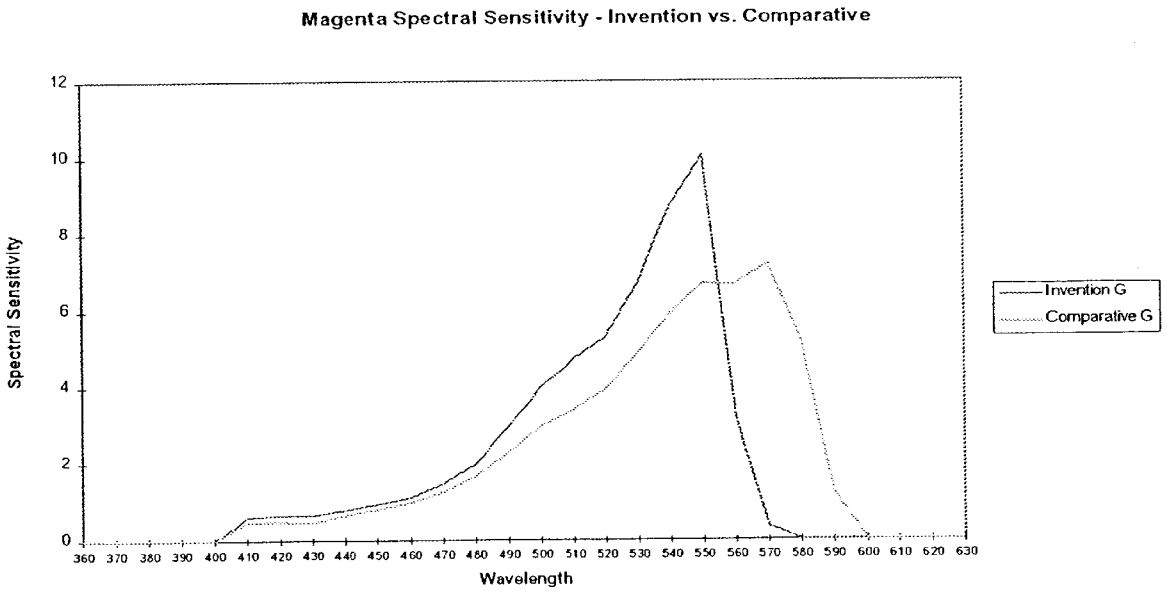
FIG. 2 shows the magenta spectral sensitivity of sample 102 illustrating the present invention versus the magenta spectral sensitivity of comparative sample 101 discussed more fully below.

FIG. 2 shows the absorption spectrum of the green light sensitive layers of samples 101 and 102. The characteristics of each spectra are reported in Table 2 below wherein λmax is the maximum absorption wavelength of the peak and $W_{h/2(\lambda max)}$ is the half bandwidth of the peak measured at λmax.

TABLE 2

| Sample | λmax (nm) | $W_{h/2(\lambda max)}$ |
|---|---|---|
| 101 | 570 | 70 |
| 102 | 550 | 42 |

The above samples were exposed by electronic filmwriter devices and a conventional 1B daylight sensitometer. When exposed to the daylight sensitometer, the samples were exposed for 1/50 sec with a 0.6 inconel filter at a color temperature 5500 K.; and developed using Kodak Process E-6 with a development time of 6 minutes. For each experiment, the green density variations between sample 101 and 102 were measured (Delta green density) for the densities 0.3, 0.5, 1, 1.5, and 2 of sample 101, at the same exposure level.

The results are reported in following Table 3.

TABLE 3

| | Delta green density (102-101) | | |
|---|---|---|---|
| Density of sample 101 | LVT | Solitaire | IB Sensitometer |
| 0.3 | −0.15 | | −0.05 |
| 0.5 | −0.2 | | −0.05 |
| 1 | −0.3 | −0.4 | −0.05 |
| 1.5 | −0.4 | −0.5 | −0.1 |
| 2 | −0.5 | −0.65 | −0.2 |

These examples show that at the same exposure level, when exposed to daylight sensitometer, the green density of the element of the invention 102 is only slightly reduced in high densities in comparison with the green density of sample 101. When exposed to the LVT or solitaire filmwriter, the element of the invention 102 gives substantially less green density than the density of sample 101. This shows that, when exposed to electronic filmwriter devices, the speed of the element of the invention is improved.

EXAMPLE 2

Comparative sample 103 was constructed similarly to sample 101 except for the following changes:

| | |
|---|---|
| Third Layer: Slow Red Sensitive Layer | |
| Silver Iodobromide Emulsion (0.44 μm ECD × 0.06 μm - 4% I) | 0.25 |
| Spectrally sensitized with | |
| Red Sensitizing Dye SD-3 | $8.82 \times 10^{-4}$ |
| Red Sensitizing Dye SD-4 | $1.04 \times 10^{-5}$ |
| Fine Grain Silver Bromide (0.055 μm ECD) | 0.04 |
| Coupler C-1 | 0.09 |
| Dispersed in Solvent S-3 | 0.04 |
| Gelatin | 0.08 |
| Fourth Layer: Mid Red Sensitive Layer | |
| Silver Iodobromide Emulsion (0.86 μm ECD × 0.09 μm - 4% I) | 0.32 |
| Spectrally sensitized with | |
| Red Sensitizing Dye SD-3 | $6.96 \times 10^{-4}$ |
| Red Sensitizing Dye SD-4 | $8.17 \times 10^{-5}$ |
| Fine Grain Silver Bromide (0.055 μm ECD) | 0.05 |
| Coupler C-1 | 0.4 |
| Dispersed in Solvent S-3 | 0.2 |
| Gelatin | 0.73 |
| Fifth Layer: Fast Red Sensitive Layer | |
| Silver Iodobromide Emulsion (1.15 μm ECD × 0.10 μm - 3% I) | 0.46 |
| Spectrally sensitized with | |
| Red Sensitizing Dye SD-3 | $6.82 \times 10^{-4}$ |
| Red Sensitizing Dye SD-4 | $7.19 \times 10^{-5}$ |
| Fine Grain Silver Iodobromide (0.15 μm ECD - 48% I) | 0.05 |
| Fine Grain Silver Bromide (0.055 μm ECD) | 0.03 |
| Coupler C-1 | 0.70 |
| Dispersed in Solvent S-3 | 0.35 |
| Gelatin | 1.18 |

-continued

| Fifteenth Layer: First Protective Layer | |
|---|---|
| UV Protection Dye UV-1 | 0.09 |
| Dispersed in Latex L-1 | 0.43 |
| UV Protection Dye UV-4 | 0.41 |
| Scavenger SCV-1 | 0.07 |
| Gelatin | 1.40 |
| Filter Dye FD-4 | 0.01 |

FIG. 1 shows the absorption spectrum of the red sensitive layers of samples 102 and 103. The characteristics of each peak are reported in Table 4 below wherein λmax is the maximum absorption wavelength of the peak and $\%A_{30}$ is % area of the peak at 30 nm hypsochromic and below, based on the total area of peak.

TABLE 4

| Sample | λmax (nm) | $A_{30}$ |
|---|---|---|
| 102 | 630 | 29% |
| 103 | 650 | 42% |

The above samples were exposed by the electronic filmwriter devices indicated below and a conventional lB daylight sensitometer in the same conditions as Example 1. For each experiment, the red density variations (Delta red density) between sample 102 and 103 were measured for the densities 0.5, 1, 1.5, and 2 of sample 103, at the same exposure level.

The results are reported in following Table 5.

TABLE 5

| | Delta red density (102–103) | |
|---|---|---|
| Density of sample 103 | LVT | Sensitometer |
| 0.5 | −0.15 | 0 |
| 1 | −0.3 | −0.03 |
| 1.5 | −0.5 | −0.03 |
| 2 | −0.55 | 0 |

These experiments show that, at the same exposure level, when exposed to daylight 1B sensitometer, the red density of the element of the invention is only slightly reduced in comparison with the red density of sample 103. When exposed to the LVT or solitaire filmwriter, the element of the invention gives substantially less red density than the density of sample 103. This shows that, when exposed to an electronic filmwriter device, the speed of the element of the invention is improved.

Compounds of samples 101, 102 and 103.

SCV-1

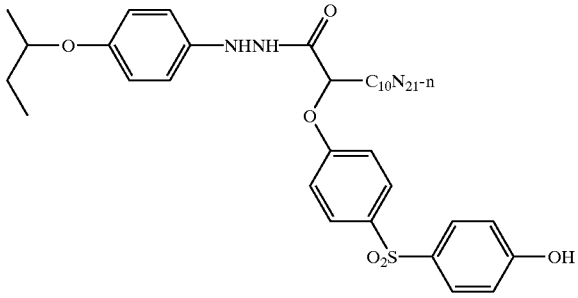

-continued

C-1

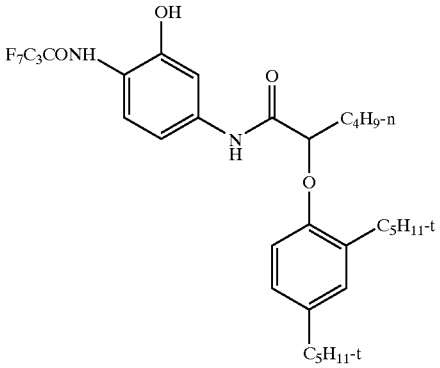

M-1

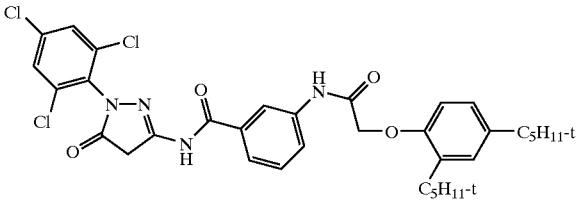

M-2

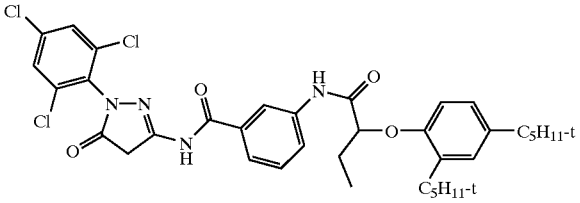

YEL-1

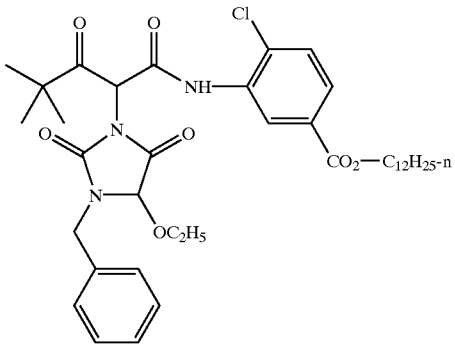

FD-1

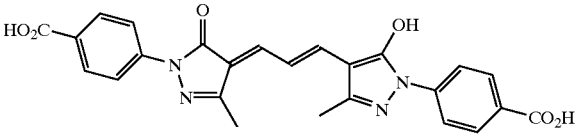

-continued
FD-2
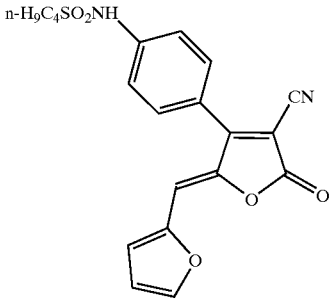
FD-3
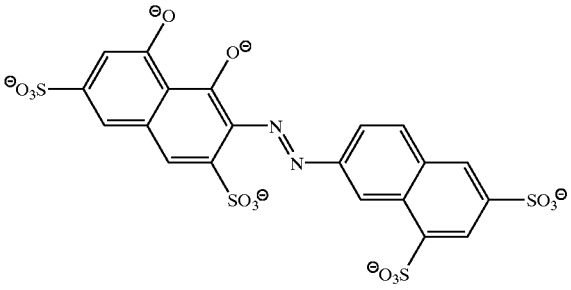
FD-4
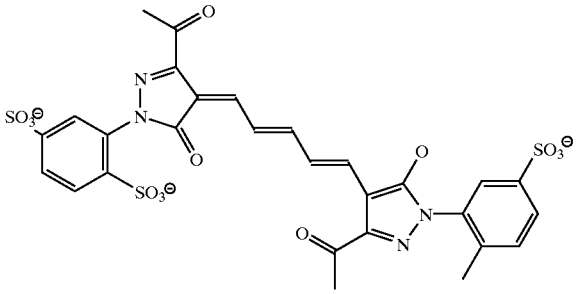
SD-1
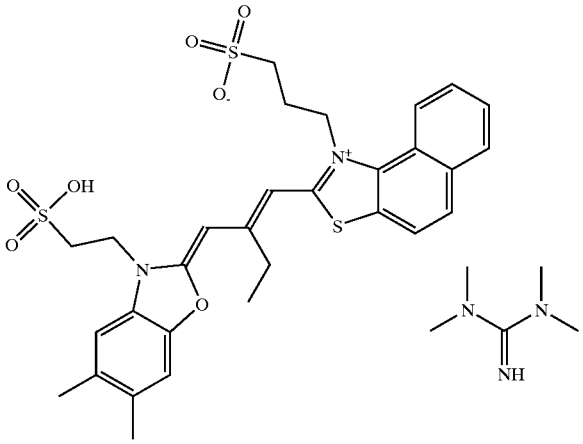
-continued
SD-2
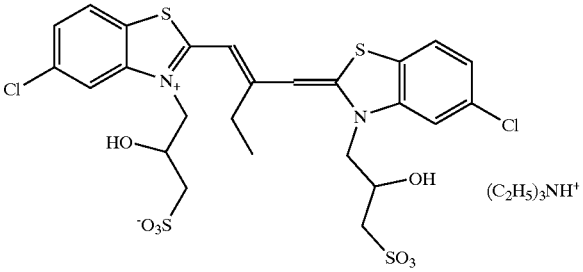
SD-3
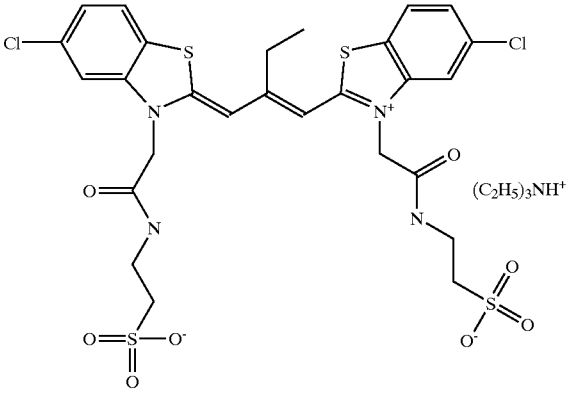
SD-4
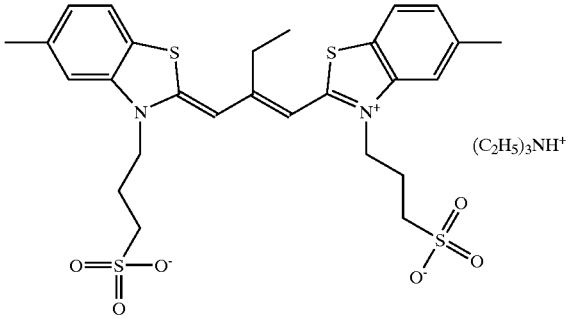
SD-5
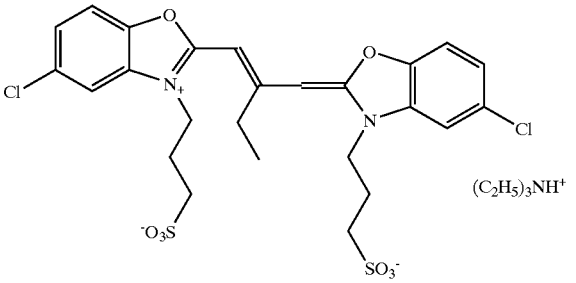
SD-6
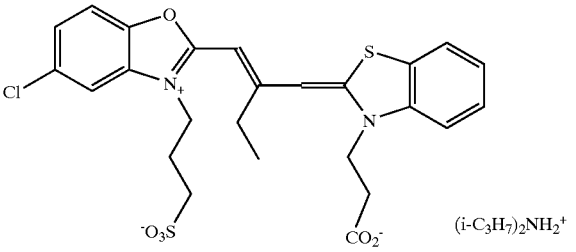

-continued

SD-7

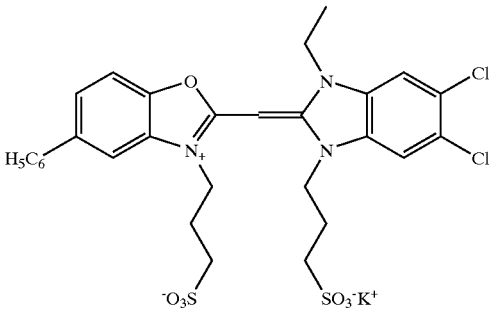

SD-8

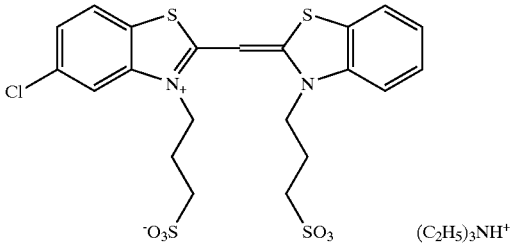

UV-1

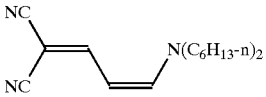

UV-4

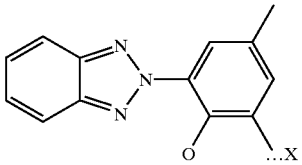

I-1

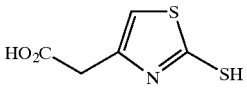

L-1

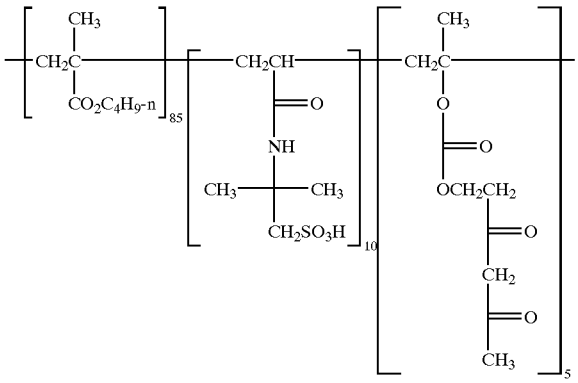

Hardener H-1 1,1'-[methylenebis(sulfonyl)]bis-ethene

Solvent S-1 1,4-Cyclohexylenedimethylene bis(2-ethylhexanoate)

Solvent S-2 Phosphoric acid, tris(methylphenyl) ester

Solvent S-3 1,2-Benzenedicarboxylic acid, dibutyl ester

The invention has been described in detail with particular reference to certain preferred embodiments thereof, but it will be understood that variations and modifications can be effected within the spirit and scope of the invention.

What is claimed is:

1. A photographic element comprising a support having thereon light sensitive silver halide layers comprising at least one red light sensitive silver halide layer, at least one green light sensitive silver halide layer, and at least one blue sensitive silver halide layer, wherein the green light sensitive silver halide layer has an absorption spectra having a maximum absorption at a wavelength λmax from 530 to 560 nm and a half bandwidth less than 50 nm; and the red light sensitive silver halide layer has an adsorption spectra having a maximum absorption at a wavelength λmax from 610 to 640 nm, and exhibiting from 30 nm hypsochromic of the wavelength of maximum absorption and below an area less than 40% based on the total area of the red light sensitive silver halide layer adsorption spectra.

2. The photographic element of claim 1 wherein the half bandwidth of the green light sensitive layer is between 35 to 50 nm.

3. The photographic element of claim 1 wherein the area of the absorption spectra from 30 nm hypsochromic of the wavelength of maximum absorption and below is less than 35% based on the total area of the red light sensitive silver halide layer adsorption spectra.

4. The photographic element of claim 2 wherein the area of the absorption spectra from 30 nm hypsochromic of the wavelength of maximum absorption and below is less than 35% based on the total area of the red light sensitive silver halide layer adsorption spectra.

5. The photographic element of claim 1 wherein the red light sensitive silver halide layer has an adsorption spectra having a maximum absorption at a wavelength λmax from 620 to 640 nm.

6. The photographic element of claim 4 wherein the red light sensitive silver halide layer has an adsorption spectra having a maximum absorption at a wavelength λmax from 620 to 640 nm.

7. The photographic element of claim 1 wherein the green light sensitive silver halide layer comprises a sensitizing dye having the following Formula (I):

(I)

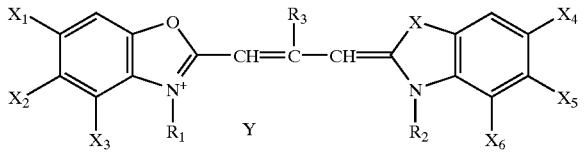

wherein $R_1$ and $R_2$ independently are an alkyl group having 1 to 6 carbon atoms; $R_3$ is an aryl group or an alkyl group having 1 to 4 carbon atoms; $X_1$, $X_2$, $X_3$, $X_4$, $X_5$, and $X_6$ independently are hydrogen, halogen, or alkyl, alkoxy, aryl, heteroaryl or acetamido groups, or $X_1$ and $X_2$, $X_2$ and $X_3$, $X_4$ and $X_5$, $X_5$ and $X_6$ can each independently be combined to form a saturated or unsaturated cyclic group, X is O or N—$R_4$ wherein $R_4$ is an alkyl group having 1 to 6 carbon atoms, and Y represents an ion as needed to balance the charge of the sensitizing dye.

8. The photographic element of claim 7 wherein $R_1$ and $R_2$ are both sulfoalkyl groups.

9. The photographic element of claim 1 wherein the green light sensitive silver halide layer comprises a sensitizing dye having the following Formula II:

(II)

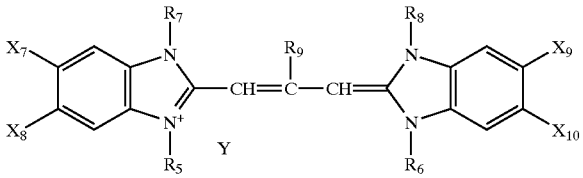

wherein $R_7$ and $R_8$ are methyl or ethyl groups provided that at least one of $R_7$ and $R_8$ is a methyl group; $R_5$ and $R_6$ are alkyl groups having from 1 to 6 carbon atoms, provided that $R_5$ and $R_6$ are not both methyl groups, $R_9$ is hydrogen, $X_7$, $X_8$, $X_9$, and $X_{10}$ are each independently methyl, methylthio, fluoro-substituted methyl or methylthio groups, or hydrogen, provided that at least one of $X_7$ and $X_8$ and at least one of $X_9$ and $X_{10}$ are not hydrogen; and Y represents an ion as needed to balance the charge of the sensitizing dye.

10. The photographic element of claim 9 wherein $R_5$ and $R_6$ are both sulfoalkyl groups.

11. The photographic element of claim 1 wherein the red light sensitive silver halide layer comprises a dye combination containing a sensitizing dye having the following Formula III and a sensitizing dye having the following Formula IV:

(III)

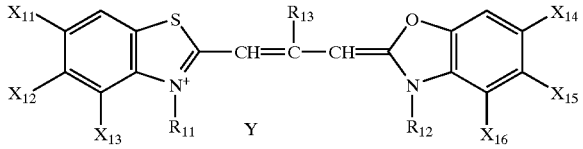

(IV)

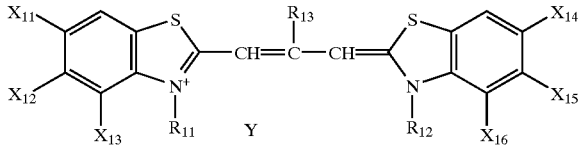

wherein $R_{11}$ and $R_{12}$ independently are an alkyl group having from 1 to 6 carbon atoms; $R_{13}$ is an aryl group or an alkyl group having from 1 to 4 carbon atoms; $X_{11}$, $X_{12}$, $X_{13}$, $X_{14}$, $X_{15}$ and $X_{16}$ are independently hydrogen, halogen, or alkyl, alkoxy, aryl, heteroaryl, or acetamido groups, or $X_{11}$, and $X_{12}$, $X_{12}$ and $X_{13}$, $X_{14}$ and $X_{15}$, or $X_{15}$ and $X_{16}$ each independently are combined to form a saturated or unsaturated cyclic group; and Y represents an ion as needed to balance the charge of the sensitizing dye.

12. The photographic element of claim 11 wherein $R_{11}$ and $R_{12}$ are both sulfoalkyl groups and wherein the compounds of Formula (III) and (IV) do not contain fused ring or aryl substituents.

13. The photographic element of claim 11 wherein the green light sensitive silver halide layer comprises a sensitizing dye having the following Formula (I):

(I)

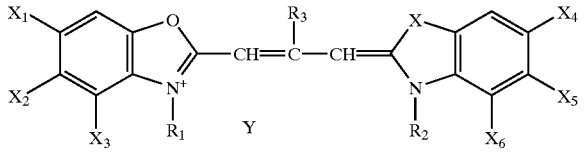

wherein $R_1$ and $R_2$ independently are an alkyl group having 1 to 6 carbon atoms; $R_3$ is an aryl group or an alkyl group having 1 to 4 carbon atoms; $X_1$, $X_2$, $X_3$, $X_4$, $X_5$, and $X_6$ independently are hydrogen, halogen, or alkyl, alkoxy, aryl, heteroaryl or acetamido groups, or $X_1$ and $X_2$, $X_2$and $X_3$, $X_4$ and $X_5$, $X_5$ and $X_6$ can each independently be combined to form a saturated or unsaturated cyclic group, X is O or N—$R_4$ wherein $R_4$ is an alkyl group having 1 to 6 carbon atoms, and Y represents an ion as needed to balance the charge of the sensitizing dye.

14. The photographic element of claim 11 wherein the green light sensitive silver halide layer comprises a sensitizing dye having the following Formula II:

(II)

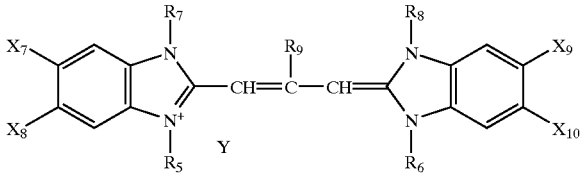

wherein $R_7$ and $R_8$ are methyl or ethyl groups provided that at least one of $R_7$ and $R_8$ is a methyl group; $R_5$ and $R_6$ are alkyl groups having from 1 to 6 carbon atoms, provided that $R_5$ and $R_6$ are not both methyl groups, $R_9$ is hydrogen, $X_7$, $X_8$, $X_9$, and $X_{10}$ are each independently methyl, methylthio, fluoro-substituted methyl or methylthio groups, or hydrogen, provided that at least one of $X_7$ and $X_8$ and at least one of $X_9$ and $X_{10}$ are not hydrogen; and Y represents an ion as needed to balance the charge of the sensitizing dye.

15. A process for forming a photographic image which comprises exposing a silver halide photographic element with light sources from an electronic filmwriter device, the element comprising a support having thereon at least one red light sensitive silver halide layer, at least one green light sensitive silver halide layer, and at least one blue light sensitive silver halide layer, wherein the green light sensitive silver halide layer has an absorption spectra having a maximum absorption at a wavelength λmax from 530 to 560 nm and a half bandwidth less than 50 nm; and the red light sensitive silver halide layer has an adsorption spectra having a maximum absorption at a wavelength λmax from 610 to 640 nm, and exhibiting from 30 nm hypsochromic of the wavelength of maximum absorption and below an area less than 40% based on the total area of the red light sensitive silver halide layer adsorption spectra.

16. The process of claim 12 wherein the half bandwidth of the green light sensitive layer is between 35 to 50 nm.

17. The process of claim 15 wherein the area of the absorption spectra from 30 nm hypsochromic of the wavelength of maximum absorption and below is less than 35% based on the total area of the red light sensitive silver halide layer adsorption spectra.

18. The process of claim 15 wherein the red light sensitive silver halide layer has an adsorption spectra having a maximum absorption at a wavelength λmax from 620 to 640 nm.

19. The process of claim 15 wherein the green light sensitive silver halide layer comprises a sensitizing dye having the following Formula (I):

(I)

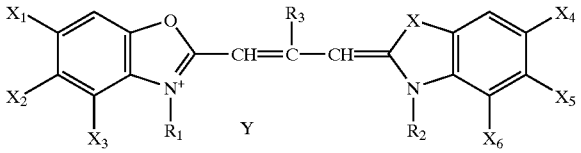

wherein $R_1$ and $R_2$ independently are an alkyl group having 1 to 6 carbon atoms; $R_3$ is an aryl group or an alkyl group having 1 to 4 carbon atoms; $X_1$, $X_2$, $X_3$, $X_4$, $X_5$, and $X_6$ independently are hydrogen, halogen, or alkyl, alkoxy, aryl, heteroaryl or acetamido groups, or $X_1$ and $X_2$, $X_2$ and $X_3$, $X_4$ and $X_5$, $X_5$ and $X_6$ can each independently be combined to form a saturated or unsaturated cyclic group, X is O or N—$R_4$ wherein $R_4$ is an alkyl group having 1 to 6 carbon atoms, and Y represents an ion as needed to balance the charge of the sensitizing dye.

20. The process of claim 15 wherein the green light sensitive silver halide layer comprises a sensitizing dye having the following Formula II:

(II)

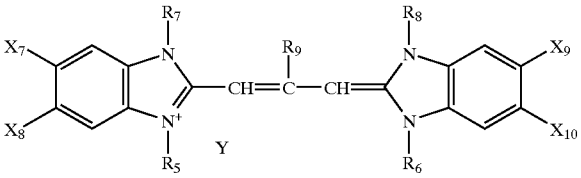

wherein $R_7$ and $R_8$ are methyl or ethyl groups provided that at least one of $R_7$ and $R_8$ is a methyl group; $R_5$ and $R_6$ are alkyl groups having from 1 to 6 carbon atoms, provided that $R_5$ and $R_6$ are not both methyl groups, $R_9$ is hydrogen, $X_7$, $X_8$, $X_9$, and $X_{10}$ are each independently methyl, methylthio, fluoro-substituted methyl or methylthio groups, or hydrogen, provided that at least one of $X_7$ and $X_8$ and at least one of $X_9$ and $X_{10}$ are not hydrogen; and Y represents an ion as needed to balance the charge of the sensitizing dye.

21. The process of claim 15 wherein the red light sensitive silver halide layer comprises a dye combination containing a sensitizing dye having the following Formula III and a sensitizing dye having the following Formula IV;

(III)

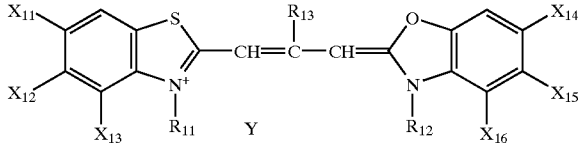

(IV)

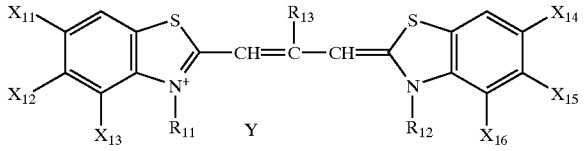

wherein $R_{11}$ and $R_{12}$ independently are an alkyl group having from 1 to 6 carbon atoms; $R_{13}$ is an aryl group or an alkyl group having from 1 to 4 carbon atoms; $X_{11}$, $X_{12}$, $X_{13}$, $X_{14}$, $X_{15}$ and $X_{16}$ are independently hydrogen, halogen, or alkyl, alkoxy, aryl, heteroaryl, or acetamido groups, or $X_{11}$ and $X_{12}$, $X_{12}$ and $X_{13}$, $X_{14}$ and $X_{15}$, or $X_{15}$ and $X_{16}$ each independently are combined to form a saturated or unsaturated cyclic group; and Y represents an ion as needed to balance the charge of the sensitizing dye.

* * * * *